US005431680A

United States Patent [19]

Jones

[11] Patent Number: 5,431,680

[45] Date of Patent: Jul. 11, 1995

[54] DEVICE FOR ORALLY ADMINISTERING LIQUID

[76] Inventor: Martyn N. Jones, Court View, 55 Sylvan Way, West Wickham, Kent, United Kingdom

[21] Appl. No.: 961,692

[22] PCT Filed: Jul. 5, 1991

[86] PCT No.: PCT/GB91/01103

§ 371 Date: Jan. 28, 1993

§ 102(e) Date: Jan. 28, 1993

[87] PCT Pub. No.: WO92/00717

PCT Pub. Date: Jan. 23, 1992

[30] Foreign Application Priority Data

Jul. 6, 1990 [GB] United Kingdom ..... 9014982
Nov. 1, 1990 [GB] United Kingdom ..... 9023804

[51] Int. Cl.[6] ..... A61J 17/00

[52] U.S. Cl. ..... 606/236; 606/234; 604/77; 604/79; 604/210

[58] Field of Search ..... 222/630, 631, 490; 604/27, 73, 77, 79, 208, 210, ; 606/234, 235, 236

[56] References Cited

U.S. PATENT DOCUMENTS

| | | | |
|---|---|---|---|
| 2,550,210 | 4/1951 | Vance | 604/77 |
| 2,764,981 | 10/1956 | Helmer et al. | 604/210 |
| 2,847,009 | 8/1958 | Blease . | |
| 3,161,196 | 12/1964 | Berkow . | |
| 3,572,337 | 3/1971 | Schunk . | |
| 4,127,126 | 11/1978 | Schunk . | |
| 4,784,641 | 11/1988 | White | 604/77 |

FOREIGN PATENT DOCUMENTS

| | | |
|---|---|---|
| 139855 | 5/1985 | European Pat. Off. . |
| 295143 | 12/1988 | European Pat. Off. . |
| 2123309 | 9/1972 | France . |
| 2231955 | 12/1974 | France . |
| 2409761 | 6/1979 | France . |

*Primary Examiner*—C. Fred Rosenbaum
*Assistant Examiner*—N. Kent Gring
*Attorney, Agent, or Firm*—Sherman and Shalloway

[57] ABSTRACT

A device having a manually operable plunger slidably mounted within a container for orally administering liquid. The plunger operates to administer the liquid through an outlet, which is at least partially surrounded by a radially extending shield.

2 Claims, 4 Drawing Sheets

DEVICE FOR ORALLY ADMINISTERING LIQUID

FIELD OF THE INVENTION

This invention relates to a device for orally administering a liquid to humans.

BACKGROUND OF THE INVENTION

Oral administration of liquids especially to children can be extremely difficult at times, such as when a measured amount of a medicine is to be given. The usual method is simply to use a spoon. The spoon may be specific to a certain measure or just an ordinary household spoon, but if the child does not want to accept the medicine it is extremely difficult to coax it to take the medicine without some loss. Alternatively too much medicine may be administered if more is given to compensate for that lost in the previous attempt. This effect is heightened considerably if the medicine is distasteful.

Alternatively a dropper can be used for oral administration. Such a device comprises a bulb head, usually made of rubber and is attached to one end of a tube. The other end of the tube has an opening through which liquid can enter. Liquid is drawn into the tube if, pressure is first applied to the bulb, the open end of the tube is placed in a liquid and the pressure then released. This device therefore provides some measure of directional control as the liquid can only leave the tube by way of the opening at its end. However since continual pressure has to be administered to the bulb in order to retain the liquid within the tube only one hand is left free to correctly position the dropper in the child's mouth. Great care is also required to ensure that the correct number of drops are administered.

Oral administration devices for humans are known from GB 1454966 which dislcoses a syringe having a cylinder and piston terminating at its outlet end with a screw cap arangement for screwing to a filling bottle. The screw cap arrangement. This is unsuitable for inserting into a child's mouth because of its relative size and terminal shape. EP-A3-0295143 shows another oral dosing syringe. Whilst this has a more friendly terminal shape it has little to prevent it being pushed too far into a child's mouth. Aural syringes, that is syringes for washing out ears, have been provided with discs at the terminal ends but these syringes are unsuitable for dosing because they do not have a plunger arrangement but merely a bulb.

SUMMARY OF THE INVENTION

A device for orally administering a liquid according to the present invention comprises a manually operable plunger slidably mounted within a container having an oral dispensing outlet, the plunger being operable to administer the liquid through the outlet, wherein the outlet is at least partly surrounded by a radially extending shield.

The radially extending shield prevents the outlet from being inserted too far into a child's mouth and has an additional advantage that it can act as a seal with a bottle top when refilling the device. In a preferred embodiment a resilient sealing disc can be placed over the outlet to abut between the shield and the bottle top.

Preferably the shield is curved backwards toward the distal end of the device. This has the advantage that it is kinder on the child's mouth and it also ensures that when locating on a bottle top during replenishing the contact with the top is better.

In one embodiment the shield also acts as handles suitably positioned near the outlet of the container, however in a preferred embodiment the shield is either formed as a uniform circular extension from the device at the outlet end or else the shield is formed with an oblong shape that is mainly extending in a single diametrical direction either side of the axis of the device.

The advantage of the circular shape is that which ever way the device is picked up it is symetrical for the use and it fits against the rim of a large open topped vessel during filling or replenishing. The advantage of the oblong shape is that when suitably positioned in a child's mouth it does not abut the child's nose. Of course the shield's shape can be circular with a cutaway nose avoiding sector.

The shield may be formed as a separate part the outlet member when this is formed as an integral part of the container and then clipped or welded in place around the outlet. Alternatively it has been found that it is easier to make the device by forming the shield integral with the outlet, making a cylindrical plunger receiving part as a separate member and then welding the cylindrical part to the outlet member. This enables the internal dimensions of the duct to be made more accurately to produce an outlet duct of only 1.0 mm.

Within limits dictated by the viscosity of the material to be administered the smaller the outlet duct the better since the dose can be more accurate.

The shield may have ridges around which assists accurate abutment of the shield on a bottle top when filling.

The plunger and terminal end of the interior of the container are preferably similarly shaped so that when the plunger reaches the outlet end of it stroke any gap between the plunger and terminal end is avoided. This ensures an accurate dose delivery.

The distal end of the plunger is preferably provided with a partial ring shaped finger engaging formation. That is the ring is incomplete allowing the finger to be inserted and removed more quickly.

The plunger receiving pare of the container may have a protrusion facing inwardly towards the axis so as to indicate a dosing capacity such as 2.5 ml. This protrusion is suitably at an intermediate position between the terminal and distal ends of the stroke of the plunger to temporarily catch the plunger. The protrusion aids accurate dosing. At the distal end of the stroke a line either internally or externally formed around the container can indicate the distal end of the stroke with a graduated capacity such as 5 ml.

Preferably the container has a pair of axially spaced external extensions between which a finger can fit either side of the container. The pair of extensions provide convenient abutments for the fingers when filling and dispensing.

The outlet is preferably formed with a bulbous terminal which makes it kinder for the mouth of the child. Preferably the container at its terminal end has an axially extending recess extending to an outlet orifice. Preferably the distance from the proximal termination of the outlet aperture to a position on the outlet portion from which the shield extends is substantially 32 millimeters (mm).

In one embodiment the container has an oblong shaped or flattened cross-section. This is advantageous when packing the device in a medicine pack. The shield axis may be skewed relative the outlet axis. This assists filling the device.

The container is preferably open at the distal end so that the plunger can be withdrawn for cleaning the device both internally and externally.

Embodiments of the invention will now be described with reference to the accompanying drawings:

DETAILED DESCRIPTION OF THE INVENTION

Figure 1:
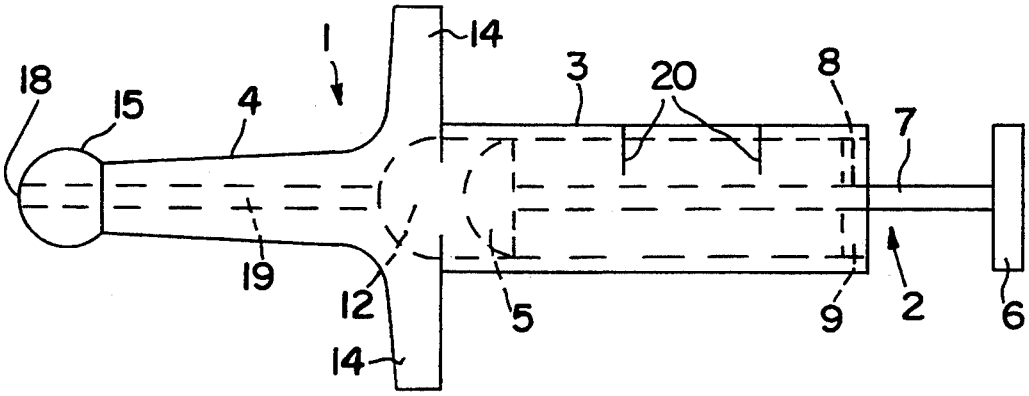
FIG. 1, shows a side view of one embodiment of a device according to the invention.

In FIG. 1 there is shown a device 1 for orally administering a liquid comprising a plunger 2, a container 3 and a conical oral dispensing portion 4. The plunger 2 has terminal and distal ends 5 and 6 respectively, end 5 being housed within the container 3 and end 6 being external to the container 3, the ends 5 and 6 are connected by a rod 7 which extends through an opening 8 in a distal end wall 9 of the container 3. The opening 8 may be of any diameter suitable to allow the rod 7 to extend therethrough with play.

A pair of handles 14 are additionally opposingly positioned on the outside of the container 3. Suitably formed and positioned, the handles act as a shield radially extending from the axis of the container.

Oral dispensing member 4 terminates in a bulb shaped portion 15. An aperture 18 at the extreme terminal end of the oral dispensing portion 4 communicates by way of a conduit or orifice 19 with the interior 12 of the container 3. Calibration or capacity marks 20 are provided on the container.

In use the oral device 1 is arranged with the plunger 2 extended fully into the container 3. The oral dispensing device 4 is then immersed into the liquid to be dispensed (not shown) and the plunger 2 withdrawn carefully so as to suck the liquid through the aperture 18 into the interior 12 of the container 3 by way of the orifice 19.

After the device is charged with the required amount of liquid, the liquid can easily be dispensed by placing the oral dispensing portion into a child's mouth (not shown) and then carefully pushing the plunger 2 fully into the container 3 thereby expelling the liquid into the child's mouth. As the oral dispensing member 4 is made of a smooth non-toxic plastics material the child is more likely to accept it and so ensure that the liquid is dispensed correctly into the child's mouth.

Figure 2:
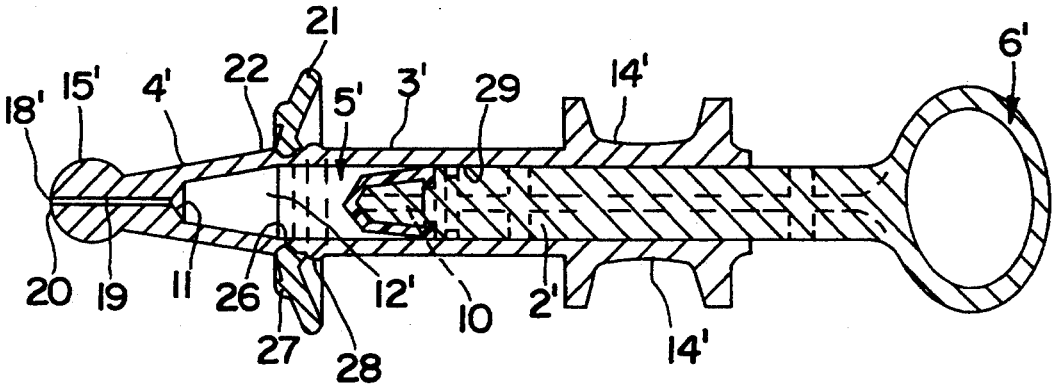
FIG. 2, shows in cross-section a second embodiment of an oral dispensing device according to the invention with a circular shield.
Figure 3:
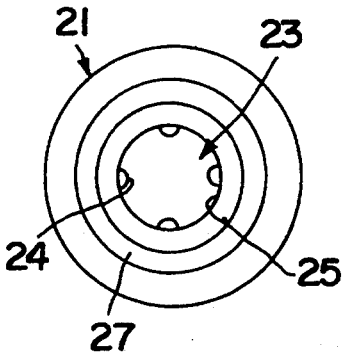
FIG. 3, is an end view of the shield of the device of FIG. 2.

In a second embodiment shown in FIGS. 2 and 3 a shield 21 having a cental hole 23 is arranged to be mounted on an outer wall 22 of the container 3'. The shield 21 acts as a safety device to prevent a child swallowing the device. The shield 21 is dished with the outer periphery curving toward the handle or distal end 6'. Four equi-spaced protrusions 24 positioned on the inward facing surface 25 of the opening 23 are arranged to fit snugly into a recess 26 in the outer wall 22 of the container 3' and so secure the ring 21 to the container 3'. The diameter of the hole 23 of the shield 21 is such that the surface 25 of the hole 23 abuts the outer wall 22 of the container 3' either side of the recess 26. Preferably the distance between the terminal end 20 and the recess 26 is 32 mm. A small flange 28 on container 3' helps retain shield 21 on wall 22 and prevents the shield from moving towards handle.

An annular ridge 27 is provided on the side of the shield 21 facing the oral dispensing portion 4' having aperture 18' in the terminal bulb shaped portion 15'. The ridge 27 is arranged so as to sealingly abut an inner circumference of a mouth of a suitable bottle (not shown) when the oral dispensing portion 4' is placed into the bottle.

Figure 4:
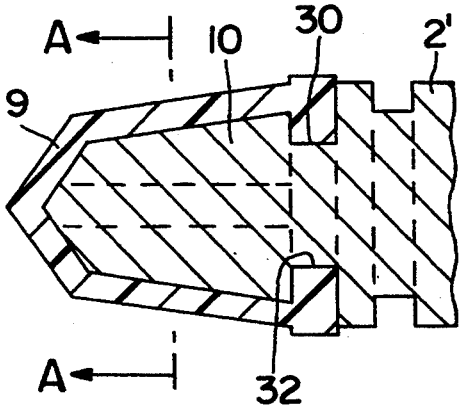
FIG. 4, is an enlarged longitudinal cross-section of the plunger of the device of FIG. 2.

In FIGS. 2 and 4 the terminal or piston end 5' of the plunger 2' is shown. This piston end comprises a head 10 which at A—A is cruxiform in shape. The head 10 has fitted over it an elastomeric cover 9 which seals against the cylindrical inner wall 29 of container 3 so as to form a piston. The head 10 and cover 9 form a fitting abutment against an extreme end 11 of an interior 12' of the container 3'. The cover 9 may be constructed of any suitable elastomeric material, preferably it is made of silicon rubber. The cover 9 is retained on head 10 by an annular groove 30 on plunger 2' which receives an intruding annular portion 32 of cover 9.

The head 10 may be made of a non-toxic plastics material preferably it is made of a plastics material covered by a silicon membrane. End 6' is so shaded as to facilitate easy manipulation of the plunger 2' in either longitudinal direction within the container 3'. Handles 14' are located either side at the distal end of the container.

Figure 5:
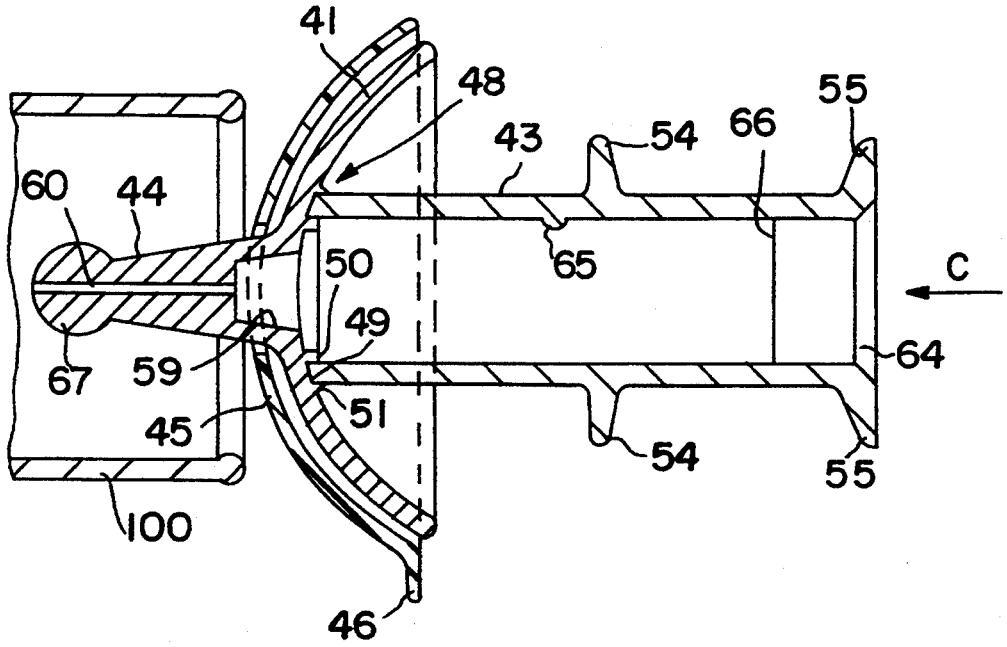
FIG. 5, is a longitudinal cross-section of a cylindrical container of a third embodiment of the invention taken on BB of FIG. 7.
Figure 6:
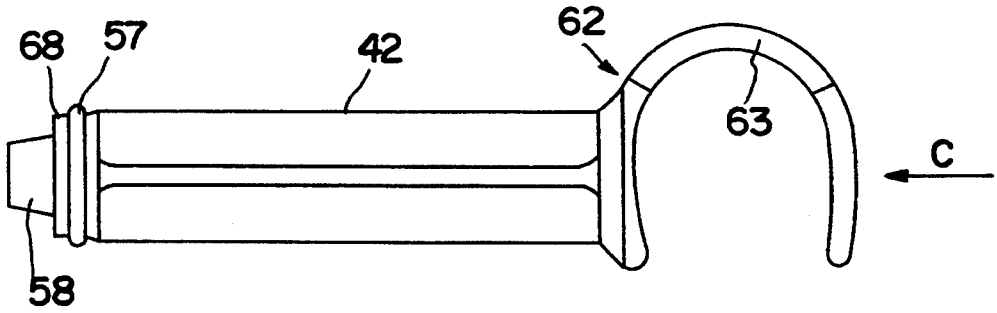
FIG. 6, is a side view of a plunger for the device of FIG. 5.
Figure 7:
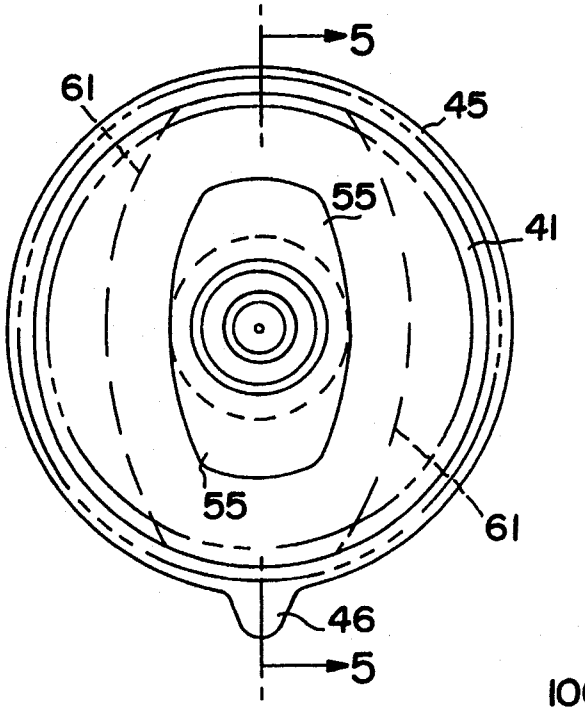
FIG. 7 is an end view of the container of the device of FIG. 5 taken from C of FIG. 5.
Figure 8:
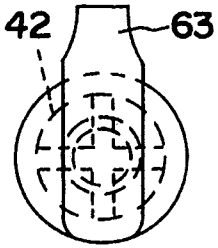
FIG. 8 is an end view of the plunger of FIG. 6 taken from C of FIG. 6.

FIGS. 5 to 8 show a third embodiment in which a container 43 formed as a cylinder has an oral dispensing or outlet portion 44 and a radially extending shield 41. These are shown in FIGS. 5 and 7. A plunger 42 is shown in FIGS. 6 and 8. The cylinder has axially spaced external diametrical extensions 54 and 55 between which a finger can fit either side of the container.

The radially extending shield 41 which prevents the outlet portion 44 from being inserted too far into a child's mouth is curved backwards toward the distal end of the device so that it is kinder on the child's. This shape enables it to locate on a top 100 of a bottle used for filling the device. A curved elastomeric washer 45 having a tag 46 for ease of removal may be provided to ensure better sealing with the bottle top 100.

In the third embodiment the shield 41 is formed as an integral part of outlet 41 and the container 43 is then welded at 48 to the shield. In order to assist the welding of shield 41 and container 43 an annular groove 49 is formed at the rear side of shield 41 between protruding ridges 50 and 51. Ridge 50 is shaped so that it fits precisely into a gap between an O-ring 57 on the terminal end of plunger 42 and plunger terminal flange 68.

Plunger 42 is also shaped at its terminal end 58 to conform precisely with a recess 59 in outlet portion 48. Recess 59 is so formed to reduce the unswept area of outlet orifice 60 which is preferably about 1 mm in diameter. Recess 59 also has the advantage of reducing the bulk of the outlet portion and this maked moulding easier. The combined shaping of plunger end 58 and the container end ensures that the maximum volume of the container is swept clean at the end of the stroke.

Also shield 41 is shown with a circular shape but it is possible to form the shield with an oblong shape as shown by broken lines 61 in FIG. 7. The advantage of the oblong shape is that when suitably positioned in a child's mouth it does not abut the child's nose.

The distal end 62 of the plunger is provided with a partial ring shaped finger engaging formation 63 which allows the users finger to be inserted and removed more quickly.

The cylindrical plunger receiving portion 43 of the container has an open end 64 through which the plunger 42 can be removed for cleaning. The outlet 44 is formed with a bulbous terminal 67 which makes it kinder for the mouth of the child. Inside the cylindrical portion 43 is a protrusion 65 which cooperates with the O-ring 57 to indicate a dosing capacity for example of 2.5 ml. A further indicator formed as a line 66 on the inside of the cylinder 43 indicates a further dosing capacity such as 5 ml.

Figure 9:
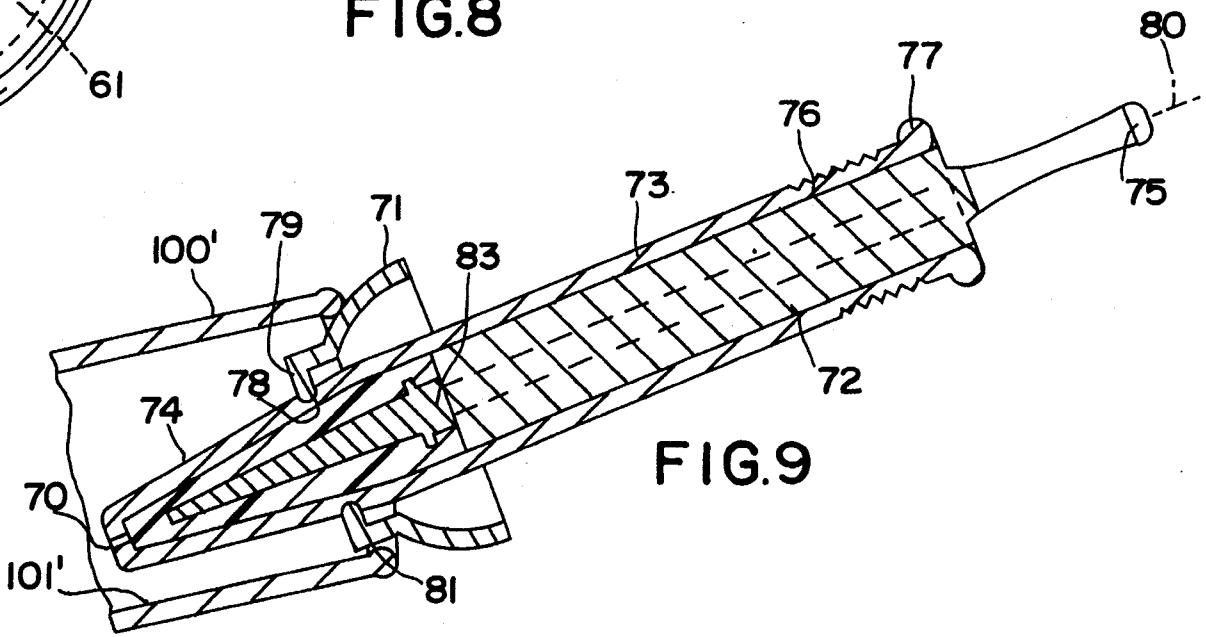
FIG. 9 is a longitudinal cross-section of a fourth embodiment of the invention taken on FF of FIG. 11.
Figure 11:
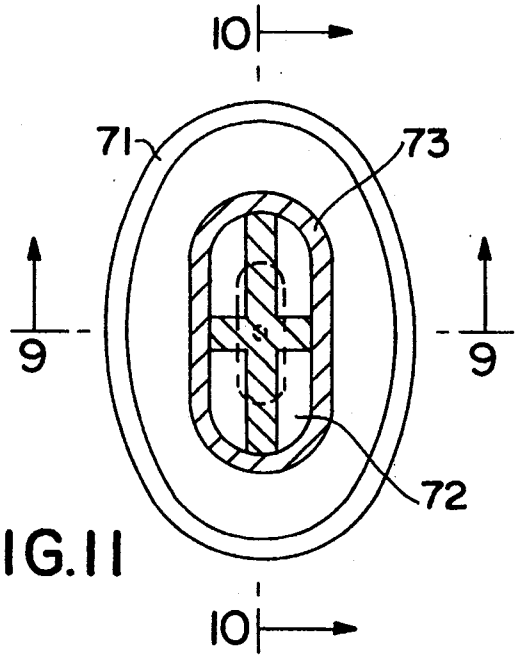
FIG. 11 is a cross section of the device of FIG. 9 taken on DD of FIG. 10.
Figure 10:
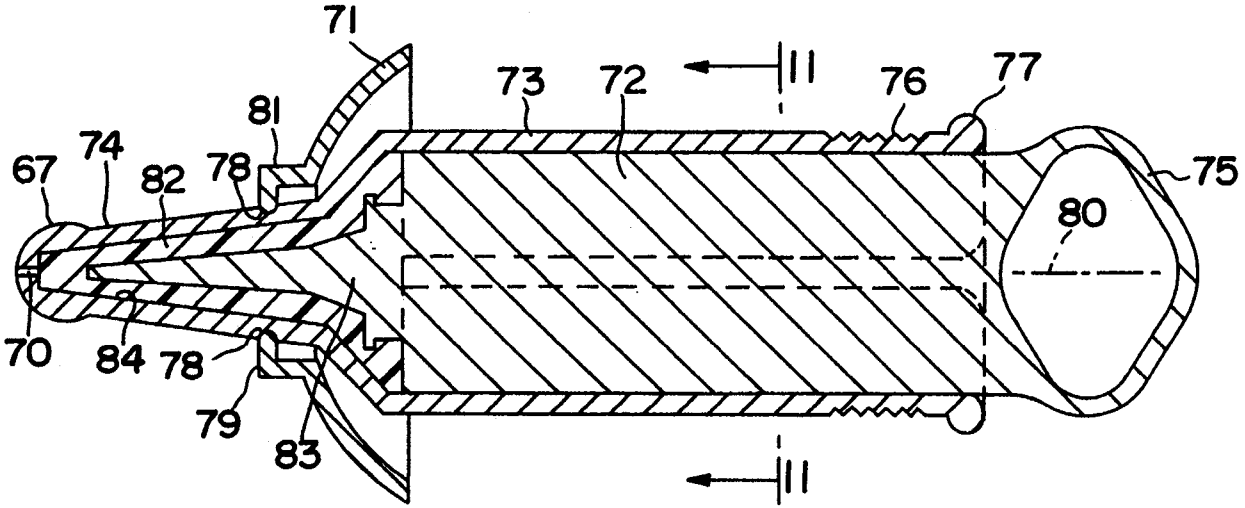
FIG. 10 is a longitudinal cross section of the device of FIG. 9 taken on EE of FIG. 11.

FIGS. 9 to 11 show a fourth embodiment of the invention in which the container 73 has an oblong or flattened cross-section seen particularly in FIG. 11. This has three advantages. Firstly with its shield 71 detached it can be packed in a medicine pack with economy of space. Secondly as shown in FIG. 9 because the outlet portion 74 is also flattened, it can be inserted into bottle 100' so that the bulbous terminal 77 also flattened can be located so that outlet orifice 70 is very close to the inner wall 101' of the bottle 100' so as to reduce the inclination of the bottle relative to the longitudinal axis 80 of the device. Thirdly the container fits easily between two fingers at a handle portion 76.

The plunger 72 is flattened to conform with cylinder 73 and has a ring shaped finger engaging formation 75.

The cylinder has its handle portion 76 toughened to provide a grip and at the distal end this portion terminates with an outwardly facing ridge 77 which has a similar function to extension 55 of the third embodiment.

The shield 71 is mounted at an angle to outlet portion 74 in a groove 78 engaging with an inwardly facing lip 79 on extension 81 of the shield. Groove 78 is coaxial with the axis of the device but may itself be skewed so that the mounting axis is skewed. This enables the outlet 70 to get nearer the bottle wall 101.

The terminal end of the plunger has a flattened conical elastomeric seal 82 which is secured to plunger end 83 in a similar way to that shown in FIG. 4. The seal shaped to conform with inner wall 84 of outlet portion 74 which has a very short orifice 70. This provides a very good swept volume.

I claim:

1. A device for orally administering a liquid comprising a manually operable plunger slidably mounted within a container having a tapered oral dispensing outlet portion extending axially from the container and terminating in an axial outlet aperture, the plunger being operable to administer liquid through the outlet wherein a shield extends radially from the outlet portion, the shield sloping rearwardly towards the distal end of the device, said outlet aperture being surrounded by a bulbous terminal portion and the tapered outlet .portion extending from the bulbous portion to a position on the outlet portion from which the shield extends, wherein an elastomeric washer is provided on the proximal side of the shield.

2. A device for orally administering a liquid comprising a manually operable plunger slidably mounted within a cylindrical container having a tapered oral dispensing outlet portion extending axially from the container and terminating in an axial outlet aperture, the plunger being operable to administer liquid through the outlet wherein a shield extends radially from the outlet portion, the shield sloping rearwardly towards the distal end of the device, said outlet aperture being surrounded by a bulbous terminal portion and the tapered outlet portion extending from the bulbous portion to a position on the outlet portion from which the shield extends wherein the plunger has a distal end finger engaging formation which is partially ring shaped so as to form a horse-shoe shaped hook with an inward curvature for retaining the device more securely to the finger, said horseshoe shaped hook capable of cooperating with the cylindrical container such that the plunger can be clipped onto the cylindrical container to facilitate the drying and cleaning of the device.

* * * * *